US008613309B1

(12) United States Patent
Bakker et al.

(10) Patent No.: US 8,613,309 B1
(45) Date of Patent: Dec. 24, 2013

(54) PIPE HANDLING APPARATUS AND METHOD

(75) Inventors: Thomas Walburgis Bakker, Vries (NL); Arno van Mourik, Amsterdam (NL)

(73) Assignee: Shell Oil Company & B.J. Services, Houston, TX (US)

( * ) Notice: Subject to any disclaimer, the term of this patent is extended or adjusted under 35 U.S.C. 154(b) by 0 days.

(21) Appl. No.: 09/889,661

(22) PCT Filed: Jan. 19, 2000

(86) PCT No.: PCT/NL00/00037

§ 371 (c)(1),
(2), (4) Date: Oct. 16, 2001

(87) PCT Pub. No.: WO00/43630

PCT Pub. Date: Jul. 27, 2000

(30) Foreign Application Priority Data

Jan. 19, 1999 (NL) ..... 1011069

(51) Int. Cl.
*E21B 19/22* (2006.01)

(52) U.S. Cl.
USPC ..... 166/77.1; 166/77.51

(58) Field of Classification Search
USPC ..... 166/77.1, 77.51
See application file for complete search history.

(56) References Cited

U.S. PATENT DOCUMENTS

| | | | | |
|---|---|---|---|---|
| 2,371,090 | A * | 3/1945 | Westin et al. | 219/149 |
| 2,548,616 | A * | 4/1951 | Priestman et al. | 175/103 |
| 5,390,846 | A * | 2/1995 | Thode | 228/219 |
| 5,735,351 | A * | 4/1998 | Helms | 168/384 |
| 6,036,076 | A * | 3/2000 | Royle | 228/102 |
| 6,220,498 | B1 * | 4/2001 | Gordon et al. | 228/173.4 |

* cited by examiner

*Primary Examiner* — Kenneth L Thompson

(57) ABSTRACT

When inserting a tube into a borehole in the ground for extracting minerals, tube parts are successively added to the proximal end of the tube while the tube reaches into the borehole. Thereafter, the tube is inserted further into the borehole. As the addition of the tube part is carried out by welding, each time an eminently sealing and slender joint between the tube parts is obtained. As the tube parts are successively added to the tube only when this is necessary for inserting the tube further into the ground, winding up the tube to store it prior to insertion is not necessary and the use of a tube-carrying reel which is difficult to handle is thus rendered redundant. Further, an installation for carrying out the proposed method is described.

14 Claims, 1 Drawing Sheet

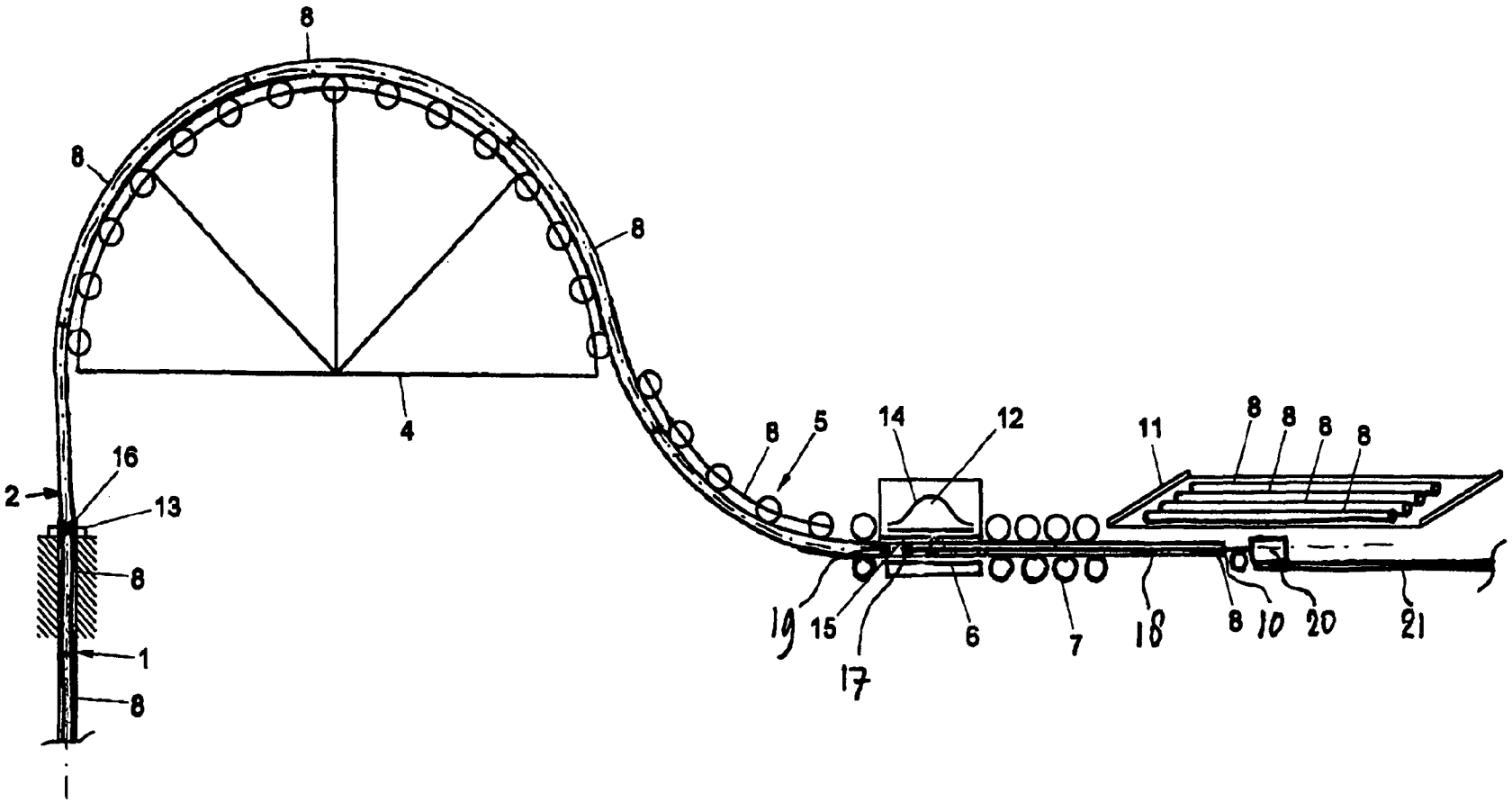
8
8
8
8
11
21
20
10
8
18
7
12
6
14
17
15
19
5
8
8
4
8
8
16
13
8
1
8
2

PIPE HANDLING APPARATUS AND METHOD

BACKGROUND OF THE INVENTION

This invention relates to a method for inserting a tube into a borehole in the ground according to the introductory portion of claim 1. This invention further relates to an installation for inserting a tube into a borehole in the ground according to the introductory portion of claim 18.

Such a method and installation are known from U.S. Pat. No. 3,677,345.

In the use of such a method and installation, for instance for drilling or lining a drilling well for extracting minerals, tube parts are successively coupled through a screw coupling to the upper end of a tube reaching into the borehole. As the tube is introduced further into the ground, tube parts are successively added by coupling them to the tube.

An inherent disadvantage is that the couplings occupy space, so that the outside diameter of the pipe adjacent the couplings increases while the inside diameter remains the same, or the inside diameter decreases while the outside diameter remains the same. Moreover, the couplings are fragile and sensitive to wear, and must be tightened with accurately controlled couples, on the one hand to ensure a proper joint and sealing and, on the other, to prevent overloading of the coupling halves.

It is also known first to form a tube by rolling a strip of material lengthwise into a tubular form and welding it along a longitudinal seam. The tube is wound onto a reel. When installing the thus obtained tube, the reel is unwound. A disadvantage of this method is that in order to obtain a reel that can be handled at all, the tube needs to be bent strongly, whereby it is subjected to strong plastic deformation when being wound onto the reel. This has an adverse influence on the mechanical properties and the geometry of the tube. Nor is this method suitable for installing concentric tubes.

SUMMARY OF THE INVENTION

It is an object of the invention to avoid, at least to a considerable extent, the drawbacks associated with the above methods and installations.

This object is achieved according to the present invention by carrying out a method of the initially indicated type in accordance with the characterizing portion of claim 1. The invention further provides an installation of the initially indicated type which is adapted according to the characterizing portion of claim 18 for carrying out the method according to the invention.

By each time welding a tube part to a proximal end of the tube while the tube reaches into the borehole, in each case an eminently sealing joint between the tube parts is obtained which, moreover, constitutes a considerably smaller thickening than do the known screw joints, or even does not constitute a thickening of significance at all. The limitation or absence of thickenings at the joints between the tube parts is moreover advantageous in that sealings of the drilling well, such as so-called blow-out preventers, do not, while the joints pass, need to adjust to large variations in the diameter of the tube.

As welding is carried out on the tube reaching into the borehole, the successive tube parts are added to the tube only when this is necessary for inserting the tube further into the ground. Winding up the tube for storage and transportation prior to insertion, as well as associated deformations, can therefore be omitted, and the use of a tube-carrying reel which is difficult to handle is thus redundant.

Particularly advantageous elaborations of the invention are set forth in the dependent claims.

Further objects, elaborations, effects and details of the invention appear from the following description of an exemplary embodiment, in which reference is made to the drawing.

BRIEF DESCRIPTION OF THE DRAWING

The FIGURE schematically shows an installation for carrying out the method according to the invention.

DETAILED DESCRIPTION

The FIGURE shows a drilling well 1 in which a tube 2 has been largely inserted. The tube 2 is made up of interconnected tube parts 8 and can be designed, for instance, as a drilling pipe or a casing. The tube 2 extends both inside and outside of the drilling well 1. Outside the well 1, the tube 2 is guided along a guide path with guides 4, 5, which guide path, starting from a proximal end 10 of the tube 2, first extends horizontally through a passage 15 and then, via smooth arcs, merges into a vertical portion in line with the borehole 1, where a lead-in device 3, which serves to retain the tube axially and in a sense of rotation, engages the tube. The guides 4, 5 are provided with rollers over which the tube 2 can roll in axial direction. Preferably, the rollers are provided with steering pins and designed as castoring wheels, so that they can also accommodate to any rotation of the tube 2.

Owing to the bent course of the guide path, the proximal end of the tube 2 is located away from the line of the well 1. The guides 4, 5 provide that the proximal end 10 of the tube 2 is oriented substantially horizontally in the area of a connecting device 6.

The geometry of the path along which the tube 2 passes is such that the tube 2 is substantially exclusively elastically deformed. As a consequence, the mechanical properties of the tube 2 remain substantially intact, and no deformations or damage to the tube occur. To achieve this, the radius of each bend in the path of the tube 2 should be so large as to give rise only to elastic deformation of the tube 2 as it passes through the bend. The minimum allowable radius depends inter alia on the geometry and material properties of the tube used. For certain kinds of tubes which are often used in oil extraction, such as 3.5-6 inch, for instance a radius in the order of 10-20 m and preferably 13-17 m can be utilized.

By means of the connecting device 6, the tube 2 can be extended by a next tube part 8. Such tube parts 8 are present in a storage 11, where these tube parts 8, in this example, are stored horizontally and parallel to an end portion of the tube 2 adjacent to the proximal end 10 of the tube 2.

For extending the tube 2 by a new tube part, a tube part 8 is taken from the storage 11 and supplied to the connecting device 6 by means of a conveyor 7. The connecting device 6 is designed as a mechanized welding machine for orbital welding of a joint between tube parts to be coupled together in line with each other. Such devices are commercially available and therefore not further described here. The proximal end 10 of the tube 2, while a next tube part is being welded to it, is also located in the welding machine 6.

By virtue of the form in which the tube 2 is held by the guides 4, 5, the proximal end 10 of the tube 2 is spaced away from the bored well 1. As the provision of a next tube part 8 can take place remote from the well 1, the area adjacent the bored well 1 is now made available for other activities, and jointing can take place at a location where more space is available and where there is less risk due to large moving parts. Incidentally, this effect is also of advantage if the connection between the tube and a tube part to be added is obtained in a manner other than through welding. In the making of the connections by welding, however, a suitable location and orientation of the tube parts to be connected are of particular importance.

Further, the space 12 where welding occurs is screened off from the drilling environment and the climate by a screening 14, so that the coupling operations can be carried out unhindered and under controlled conditions. The horizontal distance between the well head 13 and the place where welding occurs is preferably at least 10 m and more particularly preferably at least 15 to 17 m.

In the case of boreholes where oil and/or gas may be found, an area around the well head 13 moreover involves a risk of fire and explosions. By carrying out the jointing operations at a distance from the well head 13, they can be carried out outside the area involving particular risk of fire and explosion.

In the exemplary embodiment, the tube parts 8 are added to the tube 2 horizontally relative to the bored well; however, the invention is not limited thereto. Other positions spaced away from the bored well can also be used, such as, for instance, spaced away in line with the bored well, parallel to the bored well, or at an oblique angle to the bored well.

The welding machine 6 welds a tube part 8 to the tube 2 each time when the proximal end 10 of the tube 2 has reached the welding zone of the welding machine 6. The tube 2 is thereby lengthened by the length of the tube part 8.

Thereupon, the tube 2 is displaced over the length of the tube part 8 just added, along the above-described path, whereby the tube 2 is inserted deeper into the bored well 1. To that end, the lead-in device 3 is put into operation.

As the tube parts which are added to the tube 2 reaching into the borehole 1 have a length smaller than 20 m and preferably a length of 11-15 meters, the area where a tube part 8 is coupled to the tube 2 is relatively easy to access via the residual free end 10 and the interior of that tube part 8. This provides the possibility of carrying out different operations in that area and the surroundings, prior to, during and after attaching a tube part 8 to the tube 2. Such operations can comprise, for instance, post-treating the inner wall of the tube to make the tube smoother or align it better in the area of the joint, or displacing a barrier 19 in the longitudinal direction of the tube 2 to thereby prevent the possibility of fluids from the bored well reaching the welding area via the interior of the tube 2.

For the accessibility of the area where a tube part 8 has been added to the tube 8, it is further advantageous that the tube parts 8 which are added to the tube 2 reaching into the borehole 1 are straight.

The barrier 19 controls fire and explosion risks in that it prevents the possibility of gases and liquids from reaching the area where welding occurs, by way of the interior of the borehole tube. To that end, during the addition of a tube part 8 to the tube 2, the tube 2 is held internally sealed in an area which, viewed in the longitudinal direction of the tube 2, is located between an area where the tube part 8 to be added is welded to the tube 2 and the borehole 1. Preferably, the barrier 19 is then located close to the area where welding takes place, so that it is readily accessible for displacement, after welding, in the proximal direction through the tube 2. This can be done, for instance, by keeping the barrier 19 in place while the tube is inserted further into the well 1.

According to this example, for displacing the barrier 19, there is provided a tool 17 which engages the internal barrier 19 in the tube 2 and displaces said barrier 19 axially through the tube 2, at least after adding a tube part 8.

Displacing the barrier 19 axially through the tube 2 is then done in each case prior to the addition of a next tube part 8 because the barrier 19 is then still relatively properly accessible.

Due to the barrier 19 being displaced after addition of each tube part 8, the time-consuming recovery of so-called packers from an installed tube is no longer necessary. For that matter, the barrier 19 can be constructed as a packer known per se. Further, time can be saved in that the displacement of the barrier 19 can be simply carried out during an axial displacement of the tube by retaining the barrier 19. For the purpose of retaining the barrier 19, there is provided an operating structure 18 which projects from a runner 20 which is reciprocable along a longitudinal guide 21. The displaceability of the operating structure 18 serves to enable it to be retracted for bringing a next tube part 8 in position in line with the tube 2.

The tool 17 is further designed as a reamer for reaming an inner wall surface of the tube 2 in the area where the added tube part 8 is welded to the tube 2. Although a separate tool can be used for reaming, it is preferred to combine the provisions for reaming and for engaging the barrier in one tool 17. In that case, fewer displacements of the tool 17 in the longitudinal direction of the tube 2 are needed.

Reaming is also operated by the operating structure 18 extending via the proximal end 10 to the area where the added tube part 8 is welded to the tube 2. To that end, the runner 20 is provided with a drive for rotating the operating structure 18 about its longitudinal axis. It is also possible to carry out the reaming operating by having the reamer stand still and utilizing the rotary movement of the tube 2 about its longitudinal axis, described hereinafter, which serves to facilitate drilling or insertion.

In this example, the lead-in device 3 is further adapted for rotating the tube 2. The portion of the tube projecting outside the borehole 1 then rotates about its axis. As the tube 2 in the area of the guides 4, 5 is exclusively elastically deformed, this is possible without essential disadvantageous consequences for the loadability and geometry of the tube parts 8 in question. In particular, according to the invention, the rotation of the tube 2 can be utilized during drilling or the insertion of a so-called casing.

Although this example is based on a single tube, the invention is also applicable in the case of concentric tubes. The different concentric tube parts can be inserted one after the other in the bored well, or be installed simultaneously.

The invention can be applied with particular advantage when inserting tubes into a well with an overpressure prevailing under a sealing 16 at the upper end of the well, a situation sometimes referred to as "underbalanced". As the welded tube has a much more constant, and preferably a substantially constant, outside diameter than a tube composed of tube parts screwed together, the borehole 1 adjacent the well head 13 and tube can be better sealed by means of a valve, such as, for instance, a blow-out preventer. It is then especially of importance that the sealing 16 of the valve against the tube only needs to be able to bridge differences in diameter that are considerably smaller than is the case when a tube composed of parts screwed together is used.

The substantially constant thickness or outside diameter of the tube 2 in the area of the connections between the constituent tube parts 8 is also advantageous in that the tube 2 is consequently easier to pass along the guides 4, 5 which force the tube from a straight configuration via a bend to a straight configuration in and above the well.

It will be clear to those skilled in the art that within the scope of the invention, many alternative modes are possible that are different from the example described hereinabove.

Thus, the proposed method of inserting a tube and the installation proposed in that context can be used, for instance, with various kinds of wells which are used for extracting minerals or taking samples for that purpose. Also, what has been proposed is applicable for inserting various kinds of tube parts, such as, for instance, casings, drilling pipes, production liners, and clad tubes. Further, the insertion and/or rotation of the tube may or may not be interrupted when a tube part is being added.

The invention claimed is:

1. A method for inserting a tube into a borehole, comprising successively adding a straight tube part to a proximal end of the tube while the tube enters the borehole, and subsequently inserting the tube further in the borehole, wherein the addition of each tube part is carried out by means of welding and wherein, after welding, a tool is inserted to an inner surface adjacent to the weld by a structure extending via the proximal end to the area adjacent to the weld, characterized in that said tool performs a reaming operation in said inner surface adjacent to the weld, for making an inner wall surface of the tube smoother.

2. A method according to claim 1, wherein during the addition of a tube part, a joint is formed of a thickness substantially equal to the thickness of adjacent tube parts.

3. A method according to claim 1, wherein the welding is carried out at a position spaced away from the borehole.

4. A method according to claim 1, wherein the welding takes place in a screened space.

5. A method according to claim 1, wherein during welding the next tube part is out of alignment with a proximal portion of the borehole.

6. A method according to claim 5, wherein during welding the next tube part is oriented at an angle with respect to a proximal portion of the borehole.

7. A method according to claim 6, wherein during welding the next tube part is oriented horizontally.

8. A method according to claim 1, wherein tube parts after addition follow a preceding tube part to the borehole along a curved path.

9. A method according to claim 8, wherein said tube parts proceeding along said curved path are bent and thereby are deformed exclusively elastically.

10. A method according to claim 1, wherein the borehole in the area of a well head is held sealed against the tube and wherein an overpressure prevails under the sealing.

11. A method according to claim 1, wherein the tube parts which are added to the tube reaching into the borehole have a length smaller than 20 m.

12. A method according to claim 1, wherein the tube reaching into the borehole, during the addition thereto of a tube part, is held internally sealed in by an internal barrier in an area which, when viewed in the longitudinal direction of the tube, is located between an area where the tube part to be added is welded to the tube and the borehole.

13. A method according to claim 12, wherein said tool engages said internal barrier in the tube and axially displaces said barrier through said tube at least after the addition of a tube part.

14. A method according to claims 13, wherein the axial displacement of said barrier through said tube after the addition of a tube part occurs prior to the addition of a next tube part.

* * * * *